US009048587B2

(12) United States Patent
Marsh

(10) Patent No.: US 9,048,587 B2
(45) Date of Patent: Jun. 2, 2015

(54) COAXIAL CONNECTOR WITH INNER SHIELDING ARRANGEMENT AND METHOD OF ASSEMBLING ONE

(75) Inventor: John Marsh, London (GB)

(73) Assignee: Tyco Electronics UK Ltd, Swindon,Wiltshire (GB)

( * ) Notice: Subject to any disclaimer, the term of this patent is extended or adjusted under 35 U.S.C. 154(b) by 15 days.

(21) Appl. No.: 13/262,194

(22) PCT Filed: Mar. 25, 2010

(86) PCT No.: PCT/GB2010/050506
§ 371 (c)(1),
(2), (4) Date: Sep. 29, 2011

(87) PCT Pub. No.: WO2010/112898
PCT Pub. Date: Oct. 7, 2010

(65) Prior Publication Data

US 2012/0021645 A1 Jan. 26, 2012

(30) Foreign Application Priority Data

Mar. 30, 2009 (GB) ..... 0905378.6

(51) Int. Cl.
*H01R 9/05* (2006.01)
*H01R 13/658* (2011.01)
(Continued)

(52) U.S. Cl.
CPC ..... *H01R 13/65802* (2013.01); *H01R 11/12* (2013.01); *H01R 13/5205* (2013.01);
(Continued)

(58) Field of Classification Search
CPC .. H01R 2103/00; H01R 24/40; H01R 9/0521; H01R 9/0524; H01R 9/0518
USPC ..... 439/578, 582–584, 752
See application file for complete search history.

(56) References Cited

U.S. PATENT DOCUMENTS 2,225,728 A * 12/1940 Weidenman, Sr. ..... 439/278
2,335,041 A * 11/1943 Bruno ..... 174/87
(Continued)

FOREIGN PATENT DOCUMENTS

EP 1883135 A1 1/2008
GB 458641 12/1936
JP 9097654 A 4/1997

OTHER PUBLICATIONS

International Preliminary Report on Patentability issued by the International Bureau of WIPO, Geneva, Switzerland, dated Oct. 4, 2011 for International Application No. PCT/GB2010/050506; 5 pages.
(Continued)

*Primary Examiner* — Abdullah Riyami
*Assistant Examiner* — Vladimir Imas
(74) *Attorney, Agent, or Firm* — Faegre Baker Daniels LLP

(57) ABSTRACT

Externally insulated coaxial connector (2) for connecting two electrical coaxial components, the connector comprising an insulative housing 6 defining first and second intersecting passageways (18, 20) for respectively receiving at least portions of the coaxial components and having central longitudinal axes (16, 22) which are not aligned with each other and may be mutually perpendicular. The connector further comprising a first shield member (54) which is at least partly accommodated by the first passageway (18) and a second shield member (120) which is at least partly accommodated by the second passageway (20) and is engageable with the first shield member (54) by movement of the second shield member (120) with respect to the second passageway (20). Engagement of the first and second shield members (54, 120) with each other and engagement of first and second core connection members (44, 110) with each other may be by means of push-fit inter-engagement.

17 Claims, 9 Drawing Sheets

(51) Int. Cl.

| | |
|---|---|
| ***H01R 11/12*** | (2006.01) |
| ***H01R 24/54*** | (2011.01) |
| *H01R 13/52* | (2006.01) |
| *H01R 13/74* | (2006.01) |
| *H01R 103/00* | (2006.01) |

(52) U.S. Cl.

CPC ..... *H01R13/5219* (2013.01); *H01R 13/748* (2013.01); *H01R 24/545* (2013.01); *H01R 2103/00* (2013.01)

(56) References Cited

U.S. PATENT DOCUMENTS

| | | | | | |
|---|---|---|---|---|---|
| 2,475,787 | A | * | 7/1949 | Kelsay | 174/19 |
| 2,813,144 | A | * | 11/1957 | Valach | 174/87 |
| 2,952,823 | A | * | 9/1960 | Robinson | 333/260 |
| 3,047,828 | A | * | 7/1962 | Gregson et al. | 439/248 |
| 3,150,231 | A | * | 9/1964 | Clark | 174/75 C |
| 3,432,798 | A | * | 3/1969 | Brishka | 439/322 |
| 3,480,722 | A | * | 11/1969 | Van Horssen et al. | 174/87 |
| 3,639,889 | A | * | 2/1972 | Komadina | 439/357 |
| 3,668,608 | A | * | 6/1972 | Ziegler, Jr. | 439/248 |
| 3,745,514 | A | * | 7/1973 | Brishka | 439/848 |
| 4,070,751 | A | * | 1/1978 | Hogendobler et al. | 29/882 |
| 4,131,332 | A | * | 12/1978 | Hogendobler et al. | 439/585 |
| 4,156,554 | A | * | 5/1979 | Aujla | 439/584 |
| 4,326,769 | A | * | 4/1982 | Dorsey et al. | 439/21 |
| 4,412,717 | A | * | 11/1983 | Monroe | 439/582 |
| 4,655,534 | A | * | 4/1987 | Stursa | 439/582 |
| 4,708,663 | A | * | 11/1987 | Eckart | 439/469 |
| 4,772,222 | A | * | 9/1988 | Laudig et al. | 439/578 |
| 4,792,312 | A | * | 12/1988 | Yasumoto | 439/640 |
| 4,799,900 | A | * | 1/1989 | Capp et al. | 439/585 |
| 4,932,898 | A | * | 6/1990 | Goodman et al. | 439/582 |
| 4,934,960 | A | * | 6/1990 | Capp et al. | 439/620.09 |
| 5,879,190 | A | * | 3/1999 | Maruyama et al. | 439/582 |
| 5,911,599 | A | * | 6/1999 | Masuda | 439/607.58 |
| 6,036,540 | A | * | 3/2000 | Beloritsky | 439/582 |
| 6,071,127 | A | * | 6/2000 | Acke et al. | 439/63 |
| 6,126,482 | A | * | 10/2000 | Stabile | 439/582 |
| 6,428,355 | B1 | * | 8/2002 | Machado | 439/578 |
| 6,648,674 | B1 | * | 11/2003 | Dobler | 439/460 |
| 6,679,728 | B1 | * | 1/2004 | Huang et al. | 439/579 |
| 6,705,875 | B2 | * | 3/2004 | Berghorn et al. | 439/63 |
| 6,860,761 | B2 | * | 3/2005 | Lee et al. | 439/582 |
| 6,866,543 | B2 | * | 3/2005 | Chen et al. | 439/578 |
| 6,918,785 | B1 | * | 7/2005 | Reilly | 439/472 |
| 6,976,873 | B2 | * | 12/2005 | Taguchi | 439/578 |
| 7,008,256 | B2 | * | 3/2006 | Poiraud | 439/394 |
| 7,048,577 | B2 | * | 5/2006 | Chung | 439/578 |
| 7,074,080 | B1 | * | 7/2006 | Khemakhem et al. | 439/578 |
| 7,083,469 | B1 | * | 8/2006 | Khemakhem et al. | 439/578 |
| 7,165,974 | B2 | * | 1/2007 | Kooiman | 439/63 |
| 7,419,403 | B1 | * | 9/2008 | Paynter | 439/578 |
| 7,455,550 | B1 | * | 11/2008 | Sykes | 439/584 |
| 7,682,205 | B2 | * | 3/2010 | Hall et al. | 439/752 |
| 8,157,572 | B2 | * | 4/2012 | Benham et al. | 439/63 |
| 2001/0004555 | A1 | * | 6/2001 | Harting et al. | 439/63 |
| 2004/0137790 | A1 | | 7/2004 | Lee et al. | |
| 2004/0203283 | A1 | * | 10/2004 | Chen et al. | 439/578 |

OTHER PUBLICATIONS

International Search Report and Written Opinion issued by the European Patent Office, dated Jun. 4, 2010, for related International Application No. PCT/GB2010/050506; 11 pages.

Search Report issued by the United Kingdom Intellectual Property Office, dated Jul. 30, 2009, for Priority Application No. GB 0905378.6; 3 pages.

* cited by examiner

COAXIAL CONNECTOR WITH INNER SHIELDING ARRANGEMENT AND METHOD OF ASSEMBLING ONE

BACKGROUND

The present invention relates to an externally insulated coaxial connector for connecting two electrical coaxial components with axes which are not aligned with each other and more specifically to such a connector for connecting coaxial components which are substantially at right angles to each other.

While right angle coaxial connectors are referred to below, it will be understood that the invention is also applicable to connectors for connecting non-aligned coaxial components which have central longitudinal axes which intersect at angles other than 90°. The reference to the connection of two coaxial components is intended to include the connection of a coaxial cable to a coaxial plug, the connection of two coaxial cables and the connection of two coaxial plugs.

Coaxial connectors generally include a first electrical connection means which interconnects shield portions of two coaxial components and a second electrical connection means which connects core portions of the two components. When the shield portions of the components are at ground potential, the first electrical connection means, which interconnects them, generally constitutes an exposed outer part of the connector. There are applications however in which the shield portions of the components carry current and accordingly need to be insulated. A connector for such an application is generally provided with an insulative outer housing. One way of accommodating the 90° change of direction is to provide a connector which includes a short arcuate length of coaxial cable in the housing. Due to the minimum radius of curvature of the arcuate length of coaxial cable however the height of the connector is undesirably large. Alternatively, components of the connector which accommodate the 90° change of direction may be preassembled and then encased in a housing comprising two or more parts. The disadvantage of this arrangement is that more parts than is desirable are needed and there is an additional problem in that the housing parts need to be sealed to prevent the ingress of contaminants.

SUMMARY

An object of a first aspect of the invention is to provide an improved coaxial connector and an object of a second aspect of the invention is to provide an improved method of assembling a coaxial connector.

Thus according to a first aspect of the invention there is provided an externally insulated coaxial connector for connecting two electrical coaxial components, the connector comprising an insulative housing defining first and second intersecting passageways for respectively receiving at least portions of the coaxial components and having central longitudinal axes which are not aligned with each other, the connector further comprising a first shield member which is at least partly accommodated by the first passageway and a second shield member which is at least partly accommodated by the second passageway and is engageable with the first shield member by movement of the second shield member with respect to the second passageway. By providing a connector in which the second shield member is engageable with the first shield member by movement of the second shield member with respect to the second passageway the need for an arcuate length of coaxial cable to provide the change in direction of the shielding can be avoided thus reducing the height of the connector and a one-piece housing can be employed thus reducing the number of parts and avoiding the need to seal one or more housing joints. The housing is preferably a one-piece housing which is more preferably integrally formed.

As mentioned above, the invention relates particularly to a connector wherein the central longitudinal axes are substantially perpendicular to each other.

Preferably the shield members include push-fit inter-engagement means. This will provide a particularly quick and easy means of inter-engaging the shield members. Other forms of internegagement means are however possible. The second shield member may be moved in other ways along the longitudinal axis of the second passageway into engagement with the first shield member. The second shield member may for example be configured for screw-threaded engagement with the first shield member or with the insulative housing. A further possibility is that the second shield member may be longitudinally displaceable along the second passageway and one or more fasteners or fastening means may be provided to hold the first and second shield members in an inter-engaged state.

Conveniently the push-fit inter-engagement means includes at least one resilient detent in order that inter-engagement will occur automatically once the second shield member has been moved into its final location relative to the first shield member.

A particularly secure inter-engagement means which can be designed to provide low electrical resistance and high mechanical stiffness can be provided if the push-fit inter-engagement means comprises an aperture in one of the shield members an inwardly facing surface of which is engaged by plural resilient detents of the other shield member. This arrangement has also been shown to be particularly effective in situations in which the connector is subjected to high levels of vibration for a prolonged period of time.

In order to provide a connector which is even easier to assemble and is compact, the connector preferably further includes a first core connection member which is at least partly accommodated within one of the passageways and a second core connection member which is at least partly accommodated by the other passageway and is engageable with the first core connection member by movement of the second core connection member with respect to its respective passageway. More preferably the core connection members include push-fit inter-engagement means.

The first shield member is preferably hollow and accommodates the first core connection member with an insulation member therebetween. Such an arrangement facilitates the fabrication of a sub-assembly for insertion into one of the passageways of the housing. The sub-asembly can be easily connected to a coaxial cable prior to its insertion into the housing.

Conveniently the second core connection member extends through a clearance aperture in the first shield member and an aperture in the insulation member.

So as to keep the number of components to a minimum, the shield member and the core connection member at least partly accommodated by one of the passageways are electrically isolated from each other by an annular insulation wall constituting part of the housing.

The connector may be configured for connection to a coaxial cable and a coaxial plug which constitute the two coaxial components.

The connector preferably includes a strain relief member including at least one barb positioned to bite into an external layer of a coaxial cable and configured to be urged deeper into the external layer as a consequence of urging of the cable outwardly of the housing.

Such a strain relief member has been found to be particularly effective for preventing undue strain being exerted on connections between the conducting components of a coaxial cable and the connector to which it is coupled. The barb preferably has a leading edge having an acute angle between faces defining the leading edge. The barb preferable also has a leading face, towards which the cable is drawn as it is urged outwardly of the housing, which face is disposed at an acute angle to a perpendicular to a central longitudinal axis of the cable.

According to a second aspect of the invention there is provided a method of assembling an externally insulated coaxial connector for connecting two electrical coaxial components, the method comprising the steps of: (a) providing an insulative housing defining first and second intersecting passageways having central longitudinal axes which are not aligned with each other; (b) inserting a first shield member at least partly into the first passageway; and (c) inserting a second shield member at least partly into the second passageway so that it engages and electrically connects with the first shield member.

Preferable the method includes the additional step of positioning a first core connection member at least partly within the first shield member with an insulation member therebetween. The method more preferable also includes the additional step of inserting a second core connection member at least partly into the second passageway so that it engages and electrically connects with the first core connection member.

BRIEF DESCRIPTION OF THE DRAWINGS

The invention will now be described, by way of example only, with reference to the accompanying drawings in which.

DETAILED DESCRIPTION

Figure 1:
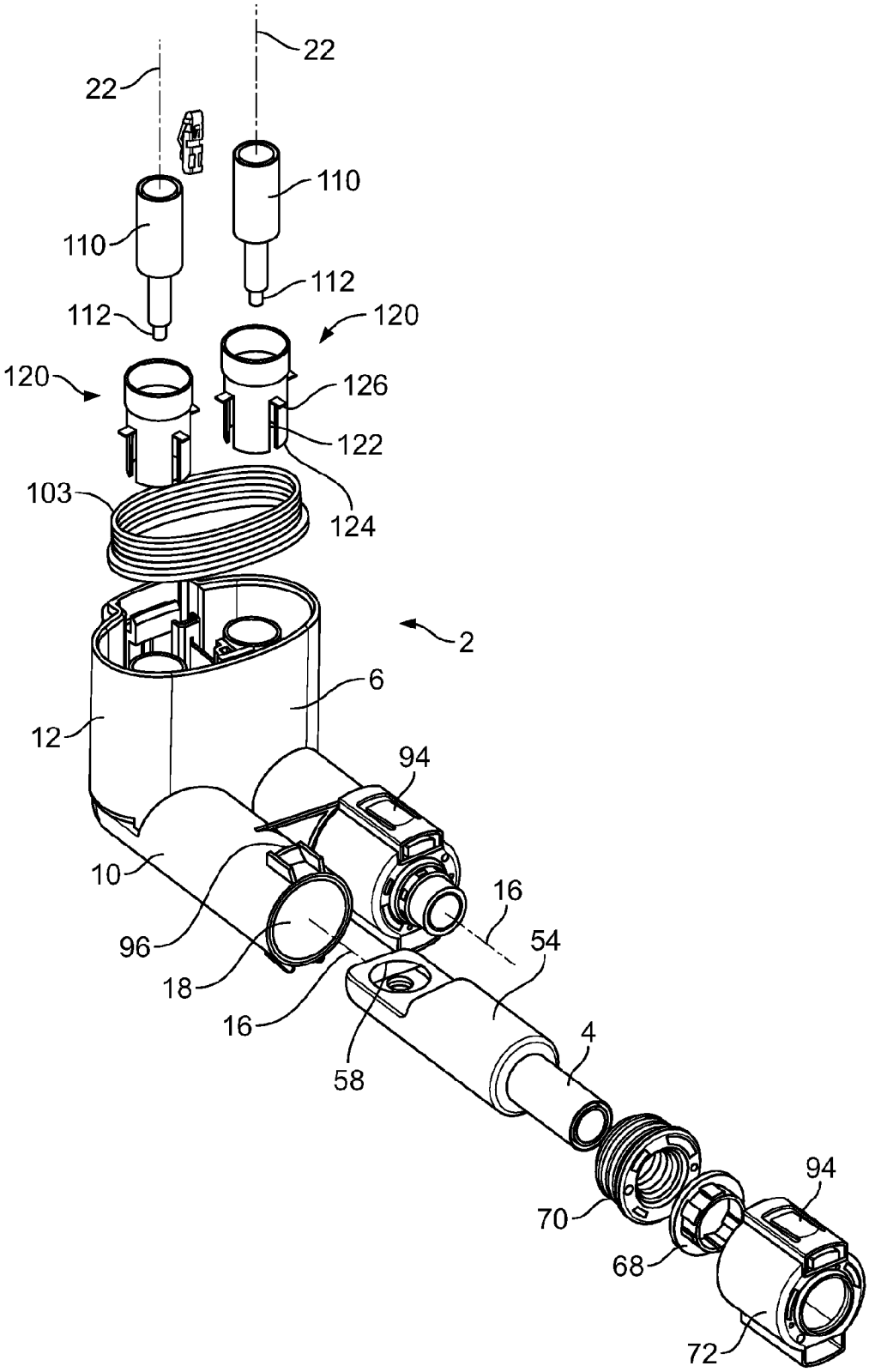
FIG. 1 shows an exploded perspective view of a connector comprising a plug connector according to a first embodiment of the invention.
Figure 2:
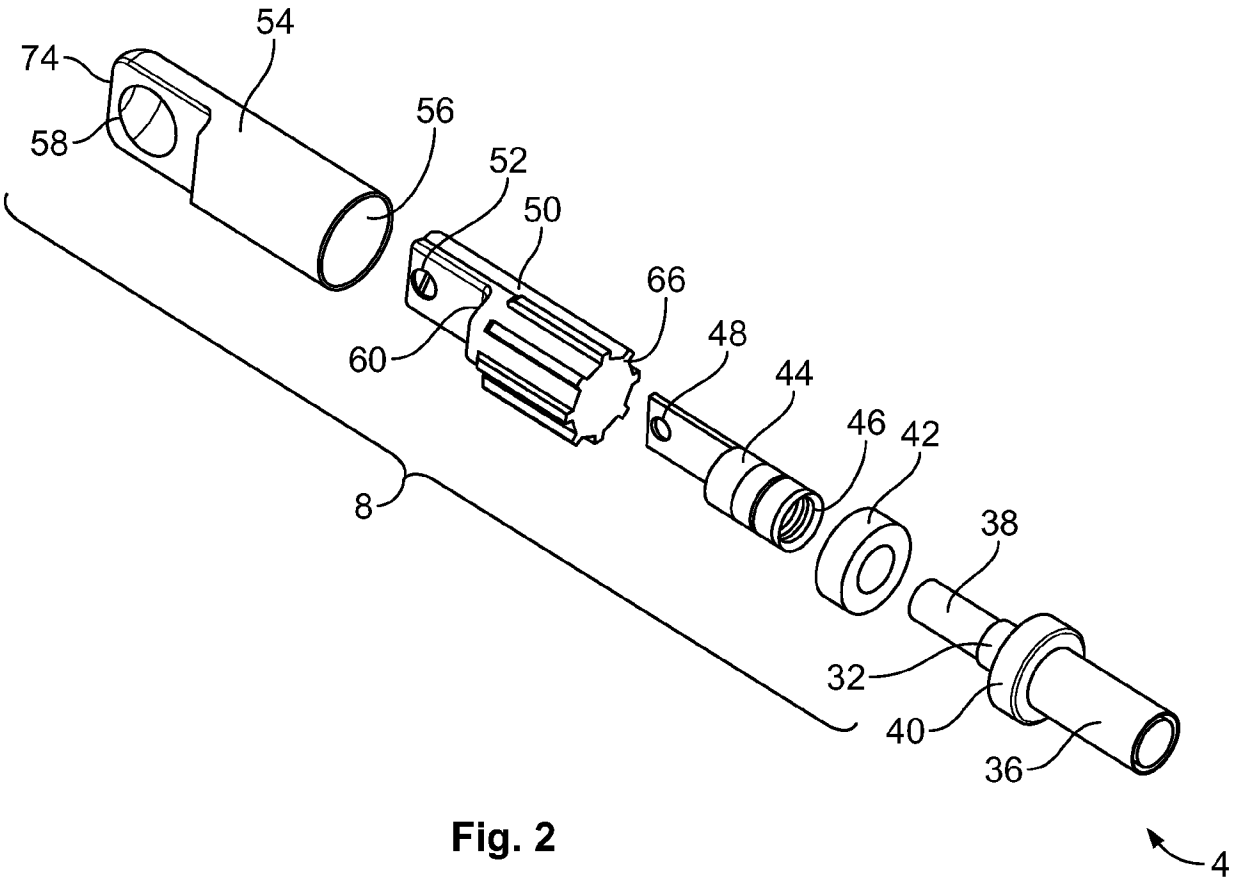
FIG. 2 shows an exploded view of one of two cable sub-assemblies of the connector shown in FIG. 1.
Figure 3:
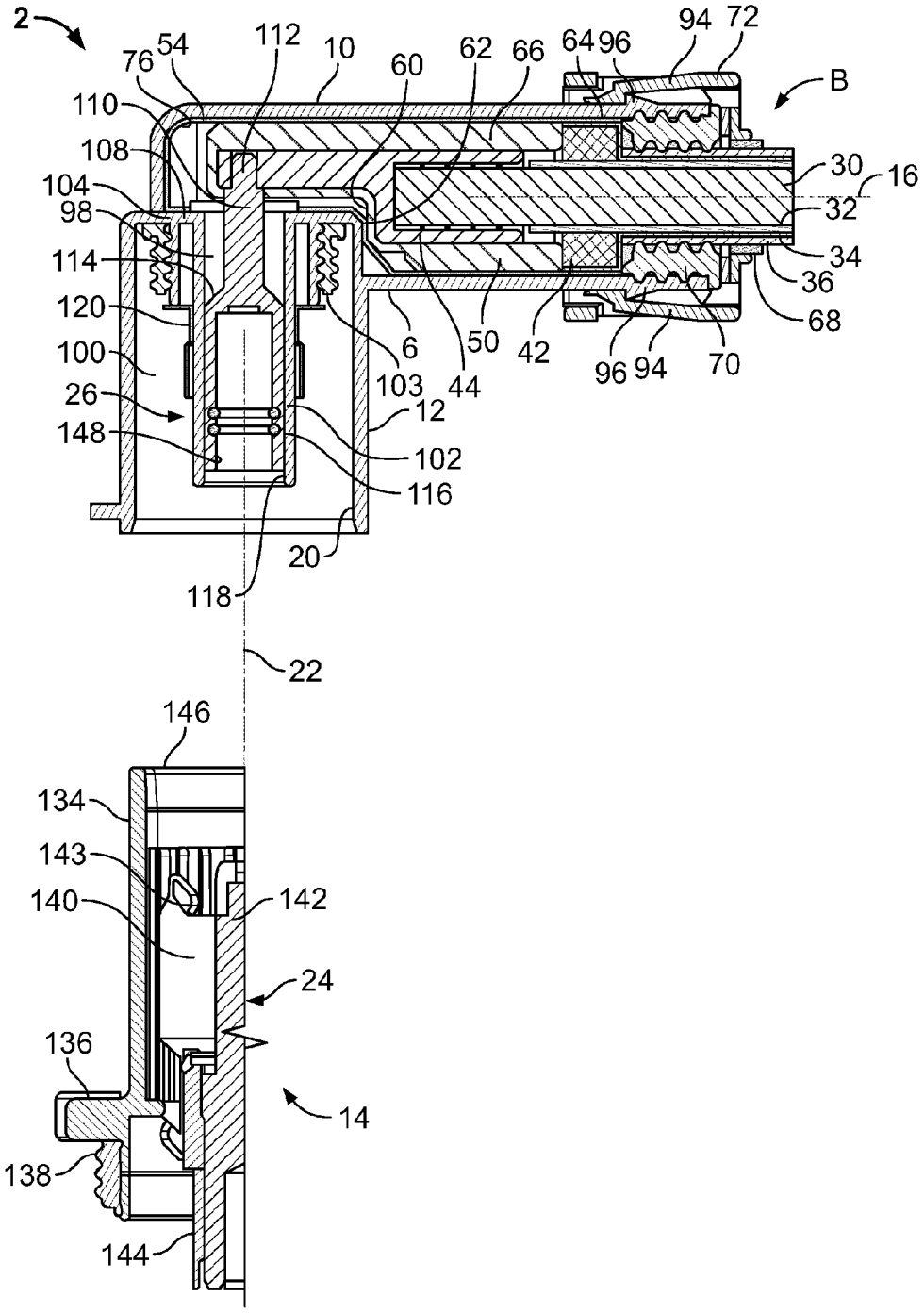
FIG. 3 shows a cross-section on the line A-A of the connector according to the first embodiment of the invention shown in FIG. 5 with a half cross-section of a complementary plug (not shown in FIG. 5) positioned for insertion into the connector.

The first embodiment of the invention shown in FIGS. 1 to 7 is in the form of a double 90° plug connector 2 for connection to two coaxial cables 4. The connector 2 includes an insulative housing 6 having a first part 10 configured to receive two cable sub-assemblies 8 each of which is adapted to be connected to the end of one of a coaxial cable 4 and a second part 12 configured to engage a complementary double header 14, a partial cross-section of which is shown in FIG. 3 in position ready to be engaged with the connector 2. The header 14 is adapted to be mounted so as to project through an aperture in a support surface and connect two coaxial cables, connected to one side of the header, to the connector 2. The housing 6 may be made from any suitable insulative plastics or other material.

While the particular embodiment described is a double connector, the invention is equally applicable to a single connector or one for connection to three or more coaxial cables. For ease of explanation the components in one side only of the connector 2 and associated header 14 will be described. The components in the other sides of the connector 2 and header 14 will be mirror images thereof and are labelled with the same reference numbers in the drawings.

The housing first part 10 includes a first passageway constituting a cable-receiving passageway 18 which has a central longitudinal axis 16. The housing second part 12 includes a second passageway constituting a header-receiving passageway 20 configured to receive the complementary header 14 shown in FIG. 3. The header 14 includes a header engagement portion 24 which is adapted to be connected to the connector 2. The housing second part 12 contains a connector engagement portion 26 adapted to engage the header engagement portion 24 and having a central longitudinal axis 22. The axis 22 of the connector engagement portion 26 intersects and is perpendicular to the axis 16 of the cable-receiving passageway 18.

The components constituting the cable sub-assembly 8 will now be described in detail with particular reference to FIGS. 2 and 3. The cable to be connected to the connector 2 includes an innermost conductive core 30 surrounded by a layer of inner insulation 32, which is surrounded by a layer of shield braid 34 which is surrounded by a layer of outer insulation 36. Once the cable 4 has been cut to length, a seal retainer 72, a strain relief 68 and a cable seal 70 are slid over the end of the cable 4 in that order. The function of these items will be described in detail below.

To prepare the cable 4 for connection to the cable sub-assembly 8, firstly the outer insulation 36, shield braid 34 and inner insulation 32 are stripped back so as to expose a core end 38. The shield braid 34 is then formed into a an annular braid connection portion 40 as shown in FIG. 2 into which an annular crimp spacer 42 of conductive material is snugly fitted so as to overlie an end portion of the inner insulation 32. The core end 38 is then slid into a passage 46 in a first core connection member in the form of a crimp terminal 44 which has a connection aperture 48 adjacent its distal end. The crimp terminal 44 is made from any suitable conductive material such as copper alloy. Connection of the crimp terminal 44 to the core end 38 is effected by inward crimping of the crimp terminal 44. An insulation member in the form of an insulation sleeve 50 is then slid over the crimp terminal 44 so that it surrounds the crimp terminal 44 and abuts the crimp spacer 42. The insulation sleeve 50 has a clearance aperture 52 which is aligned with the connection aperture 48 of the crimp terminal 44 therewithin. An exterior of the insulation sleeve 50 is provided with longitudinally disposed and radially extending spacer ribs 51.

The final component of the cable sub-assembly 8 is a first shield member in the form of a crimp shield 54 which is made from any suitable conductive material such as copper alloy and may be made by means of deep drawing or casting. The crimp shield 54 has an interior 56 configured to receive the insulation sleeve 50 and has a through engagement aperture 58 arranged to coincide with the clearance aperture 52 of the insulation sleeve 50 and the connection aperture 48 of the crimp terminal 44. The engagement aperture 58 is preferably formed by punching. Insertion of the insulation sleeve 50 into the crimp shield 54 is limited by a fist abutment surface 60 of the insulation sleeve 50 abutting with a complementary second abutment surface 62 of the crimp shield 54. The crimp shield 54, insulation sleeve 50 and crimp terminal 44 have geometries which ensure that axes of the apertures 58, 52 and 48 therein will all be aligned with each other. In the embodiment shown in FIG. 2, such alignment is achieved by the components having complementary D-shape transverse cross-sections which inter-engage with each other. Other geometries for ensuring correct alignment are however possible such as complementary ribs and grooves. A proximal end 64 of the crimp shield 54 extends beyond a proximal end 66 of the insulation sleeve 50 so as to overlie the braid connection portion 40 overlying the crimp spacer 42 and is crimped inwardly into engagement with the braid connection portion 40.

The cable sub-assembly 8, assembled as explained above, is then inserted into the cable-receiving passageway 18 of the housing 6. The Crimp shield 4 and the passageway 18 have complementary geometries which ensure that, once fully engaged with each other, the central axes of the apertures 58, 52 and 48 in the crimp shield 54, the insulation sleeve 50 and the crimp terminal 44 respectively are at least substantially aligned with the axis 22 of the associated header receiving passageway 20. In the embodiment shown in FIGS. 1 to 5, an exterior surface 74 of a distal portion of the crimp shield 54 and a complementary inner surface of the passageway 18 have complementary D-shaped cross-sections.

The cable seal 70 is then slid along the cable 4 into the passageway 18. The strain relief 68 is in the form of a ring with a radial through slot 82 and an outwardly projecting annular flange 80. A plurality of apertures 84 spaced around the strain relief 68 each contain deflectable beam 78 with a shoulder 86 on an outside surface thereof and an inwardly facing leading edge 88 having an inclusive acute angle of a° and a leading face 90 inclined at an acute angle of b° to a perpendicular to a central longitudinal axis 92 of the strain relief 68. The strain relief 68 is slid along the cable 4 until the flange 80 contacts the cable seal 70. The seal retainer 72 is then slid along the cable 4 until is engages the strain relief 68. Further urging of the seal retainer 72 towards the housing 6 causes the seal retainer 72 to firstly displace the strain relief so that it compresses the cable seal 70 and secondly force the beams 78 of the strain relief 68 inwardly so that the leading edges 88 thereof bite into the outer insulation layer 36 of the cable 4. Finally two retainer latches 94 on the seal retainer 72 engage complementary latch shoulders 96 on the housing 6 to hold the cable sub-assembly 8 securely in place in the cable-receiving passageway 18 of the housing 6.

The acute angle a° of the leading edge 88 of each beam 78 is preferably in the range 45° to 75° and is more preferably around 60°. The angle b° of the leading face of each beam 78 to a perpendicular to the central axis 92 of the strain relief 68 is preferable in the range 10° to 20° and more preferably around 15°. The strain relief 68 is particularly effective and strain on the cable 4 urging it outwardly of the housing 6 results in the leading edges 88 of the beams 78 being forced even more securely into the outer insulation 36 of the cable 4. The strain relief may constitute a separate invention independently of other features referred to in this specification.

Figure 4:
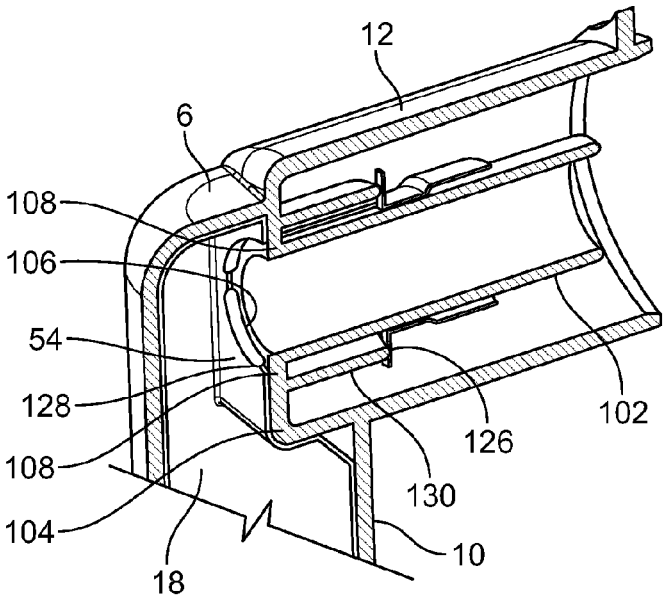
FIG. 4 shows a partial perspective cross-section of the connector housing with only two inter-engaged shield members installed therein.
Figure 5:
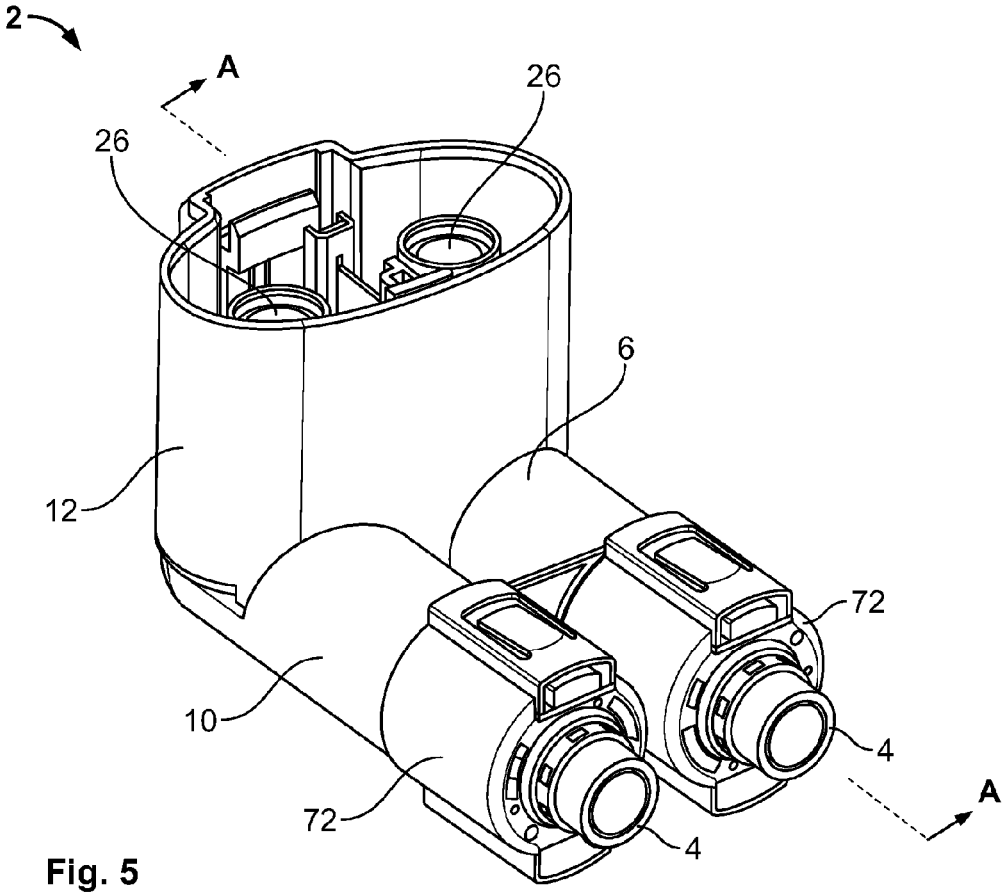
FIG. 5 shows a perspective view of the connector according to the invention with two short sections of coaxial cables connected thereto.
Figure 6:
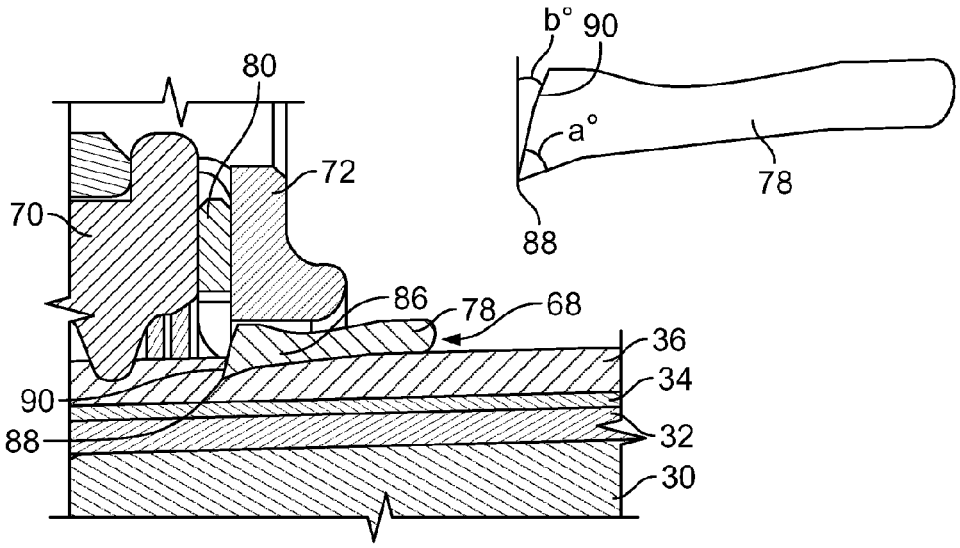
FIG. 6 shows an enlarged view of the area marked B in FIG. 3 showing the strain relief member.
Figure 7:
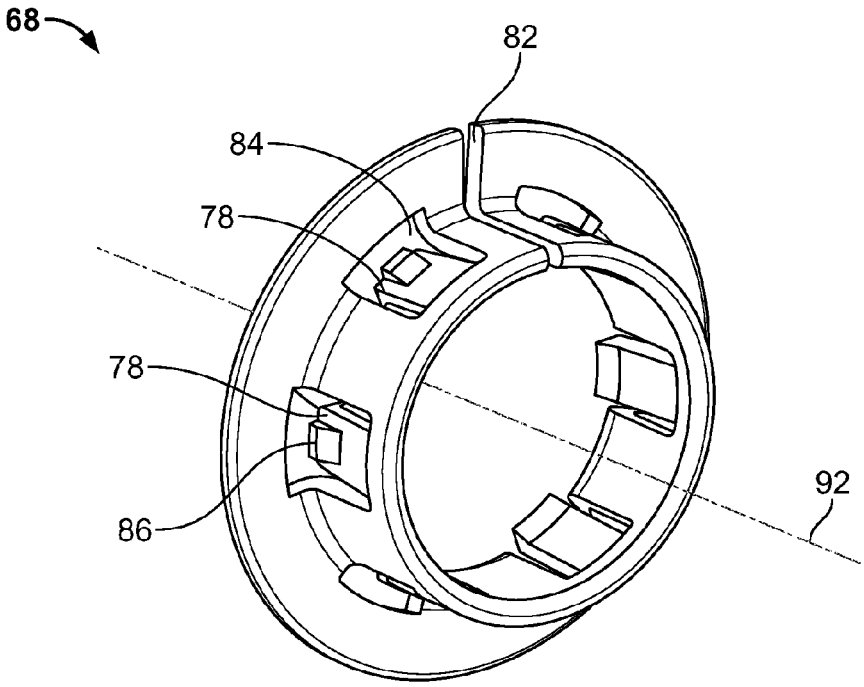
FIG. 7 shows a perspective view of the strain relief member shown in FIG. 6.

The components constituting the connector engagement portion 26 in the second part 12 of the housing 6 will now be described with particular reference to FIGS. 1, 3 and 4.

The second passageway 20 in the second part 12 of the housing 6 is divided by an integral annular insulation wall 102 into an inner passageway 98 and an outer passageway 100. The insulation wall 102 may alternatively be a separate member which is pressed or otherwise fixed to the insulative housing. An inner end of the insulation wall 102 is integrally formed with and supported by a dividing wall 104 containing four arcuate slots 106 which are radially aligned with an outer surface of the insulation wall 102. The inner end of the insulation wall 102 is connected to the dividing wall by narrow bridge portions 108 located between the arcuate slots 106. An annular stopper wall 130 extends from the dividing wall 104 outwardly of the arcuate slots 106 adjacent a proximal portion of the insulation wall 102. An elliptical header seal 103, spaced inwardly from an outer wall of the housing second part 12 is provided. The header seal 103 passes around the outside of both of the stopper walls 130.

Electrical connection with the crimp terminal 44 is effected by means of a second core connection member in the form of a core contact 110. The core contact 110 includes a distal end 112 configured for engagement with the connection aperture 48 in the crimp terminal 44. The core contact 110 also includes an intermediate lead-in portion 114. The lead-in portion 114 comprises a camming surface for engagement with the insulation wall 102 as the core contact 110 is inserted into the inner passageway 98 to centre the core contact 110 with respect to the central axis 22 of the header receiving passageway 20 and accordingly with the central axis of the connection aperture 48 of the crimp terminal 44. Prior to engagement of the distal end 112 of the core contact 110 with the connection aperture 48 of the crimp terminal 44 an outer surface 116 of the core contact 110 is slidingly guided by contact with an inner surface 118 of the insulation wall 102 to maintain the alignment referred to above. The distal end 112 engages the connection aperture 48 by means of an interference push-fit. Other forms of engagement are possible. The distal end 112 and the connection aperture 48 may be provided with inter-engageable screw threads or a threaded fastener could extend through a through hole in the core contact 110 and engage a screw-threaded hole in the crimp terminal 44. These engagement means allow so-called blind engagement of the core contact with the crimp terminal in which a fabricator can engage these components without being able to see the parts which are being engaged. The core contact 110 will simply be moved relative to the header-receiving passageway 20, by one or more of longitudinal sliding or screwing. In this way the core contact 110 will be moved in or along the header-receiving passageway into engagement with the crimp terminal 44.

Electrical connection with the crimp shield 54 is effected by means of a second shield member in the form of a shield contact 120 which may be made from any suitable conductive material such as copper alloy. The shield contact 120 has a cylindrical body with a plurality of slots 122 extending partway along the body from its leading end 124. Part of the material cut out to form each slot 122 is bent outwardly to form a tab 126. Leading end parts of the body between the slots 122 are bent outwardly to form resilient detents 122. The shield contact 122 is installed in the housing 106 by inserting it into the header-receiving passageway 20 such that its body surrounds the insulation wall 102. As insertion of the shield contact progresses its leading end 124 passes into a gap between the insulation wall 102 and the stopper wall 130 until the resilient detents 128 contact the dividing wall 104 at which point the shield contact 122 is rotated until the resilient detents 128 become aligned with the arcuate slots 106 in the dividing wall 104. Further movement of the shield contact 122 into the header receiving passageway 20 results in the resilient detents 128 passing through the arcuate slots 106. The engagement aperture 58 of the crimp shield 54 is aligned with the central axis 22 of the header-receiving passageway 20 and is situated immediately adjacent to the dividing wall 104. Consequently, as the resilient detents 128 emerge from the arcuate slots 106 they are deflected inwardly by engagement with an inwardly facing surface of the engagement aperture 58. Insertion of the shield contact 120 continues until the tabs 126 come into contact with the stopper wall 130 at which point the resilient detents 128 resile outwardly and engage an inner surface of the crimp shield 54.

The above process will be repeated so as to engage a second cable sub-assembly 8 in the second passageway 18 with a second core contact 110 and a second shield contact 120.

Engagement of the assembled connector 2 with a complementary header connector 14 will now be briefly described with reference to FIG. 3 which shows a cross-section through one half of the header connector.

The complementary header includes an outer header housing 134 with an outwardly projecting flange 136 for connection to a support surface through which the header projects. A mounting seal 138 surrounds the housing 134 for sealing engagement with the support surface. Inside the header housing 134 are two header engagement portions 24, one side of one of which is shown in FIG. 3. Each header engagement portion 24 includes a circular header shield 140 with inwardly projecting header spring contacts 143. Centrally positioned relative to the housing 134 is a header core 142 which is insulated from the header shield 140 by a header insulator 144. The header shield 140 and core 142 are made from any suitable conductive material such as copper alloy. The housing 134 is substantially elliptical, corresponds in shape to that of the second part 12 of the housing 6 of the plug connector 2 and contains two header engagement portions 24 as described above.

When the plug connector 2 is engaged with the header 14, the second part 12 of the plug housing 6 is positioned so that it surrounds the header housing 134 and the plug connector 2 is pushed into full engagement with the header 14. As this occurs a leading end 146 of the header housing 134 enters a gap between the header seal 103 and the inner surface 118 of the plug connector 2 thereby sealing the connection between the plug connector 2 and the header 14. The spring contacts 143 of the header shield 140 make electrical contact with the shield contact 120 of the plug connector 2 and the header core 142 enters and makes electrical contact with a passage 148 in the core contact 110.

A second embodiment of the invention will now be described with reference to FIGS. 8 to 13. The second embodiment comprises a header connector for mounting in an aperture of a support surface and to which two coaxial devices are connected by some means.

Figure 8:
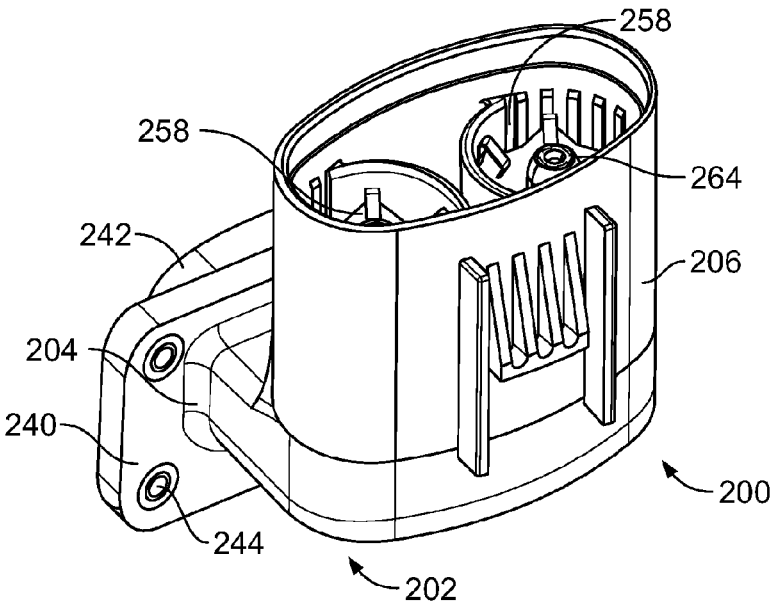
FIG. 8 shows a perspective view of a connector comprising a header connector according to a second invention of the invention.
Figure 9:
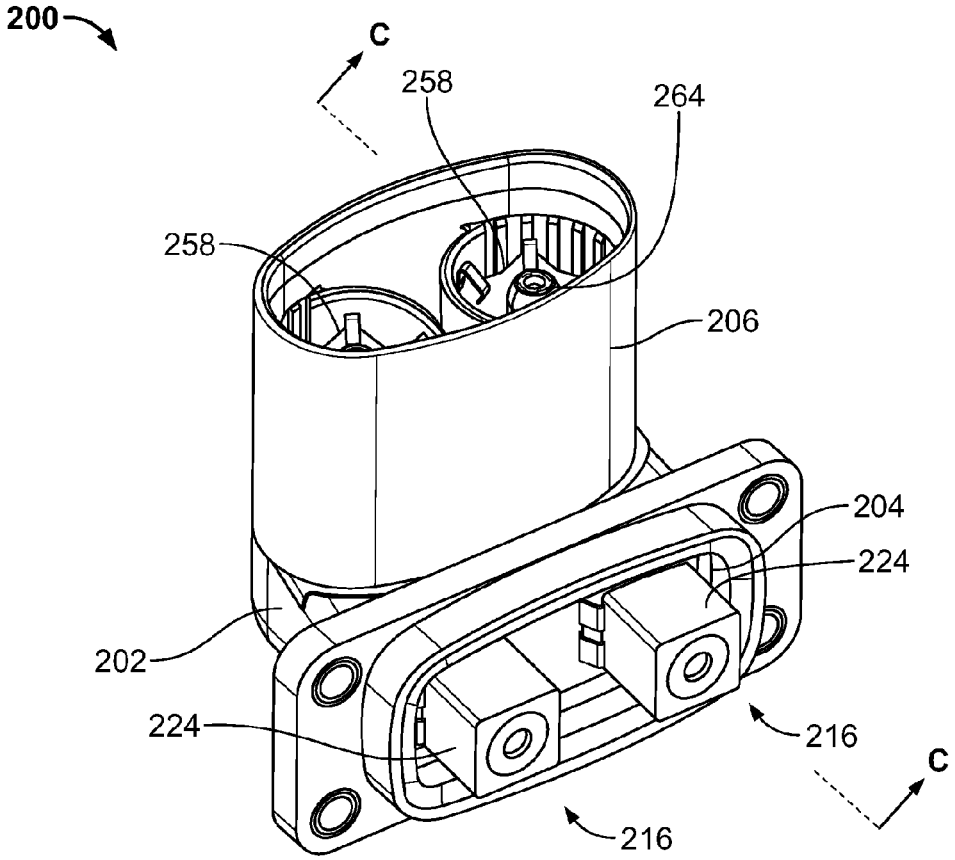
FIG. 9 shows a perspective view of the connector shown in FIG. 8 from the opposite side.
Figure 10:
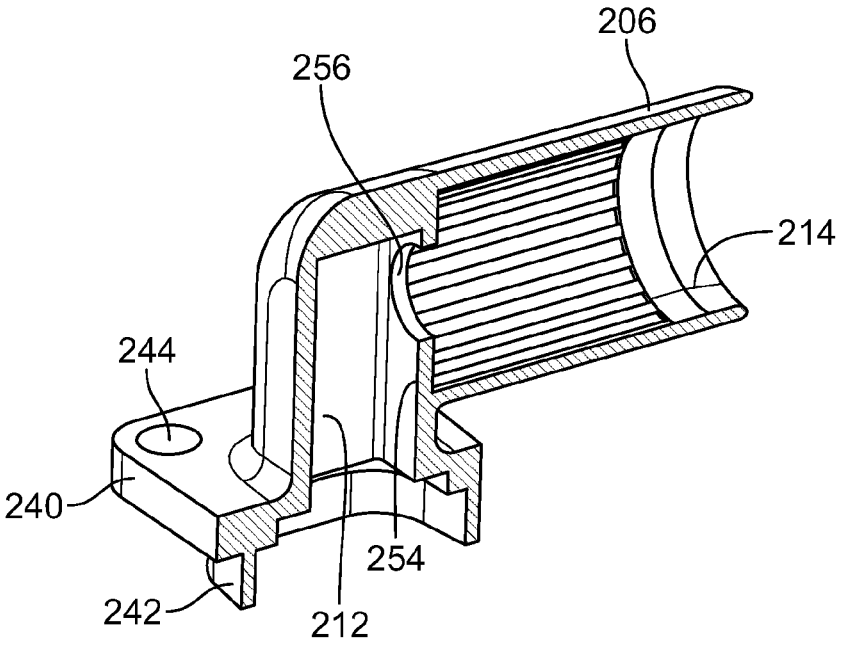
FIG. 10 shows a cross-section on the line C-C of the housing only of the connector shown in FIG. 9.
Figure 12:
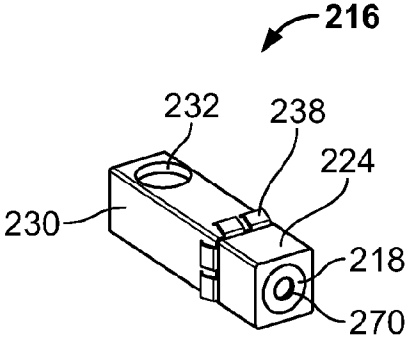
FIG. 12 shows a perspective view of one of the two cable connection assemblies of the connector shown in FIG. 11 in an assembled state.
Figure 11:
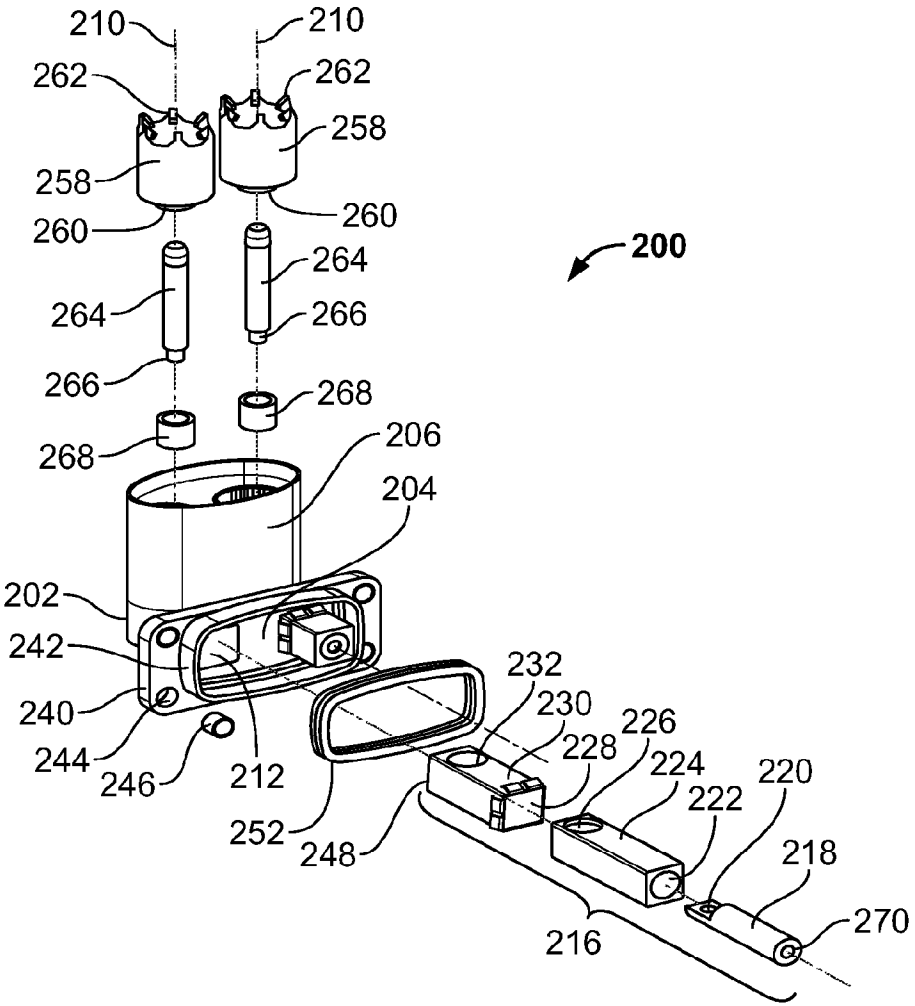
FIG. 11 shows an exploded perspective view of the connector shown in FIG. 8.
Figure 13:
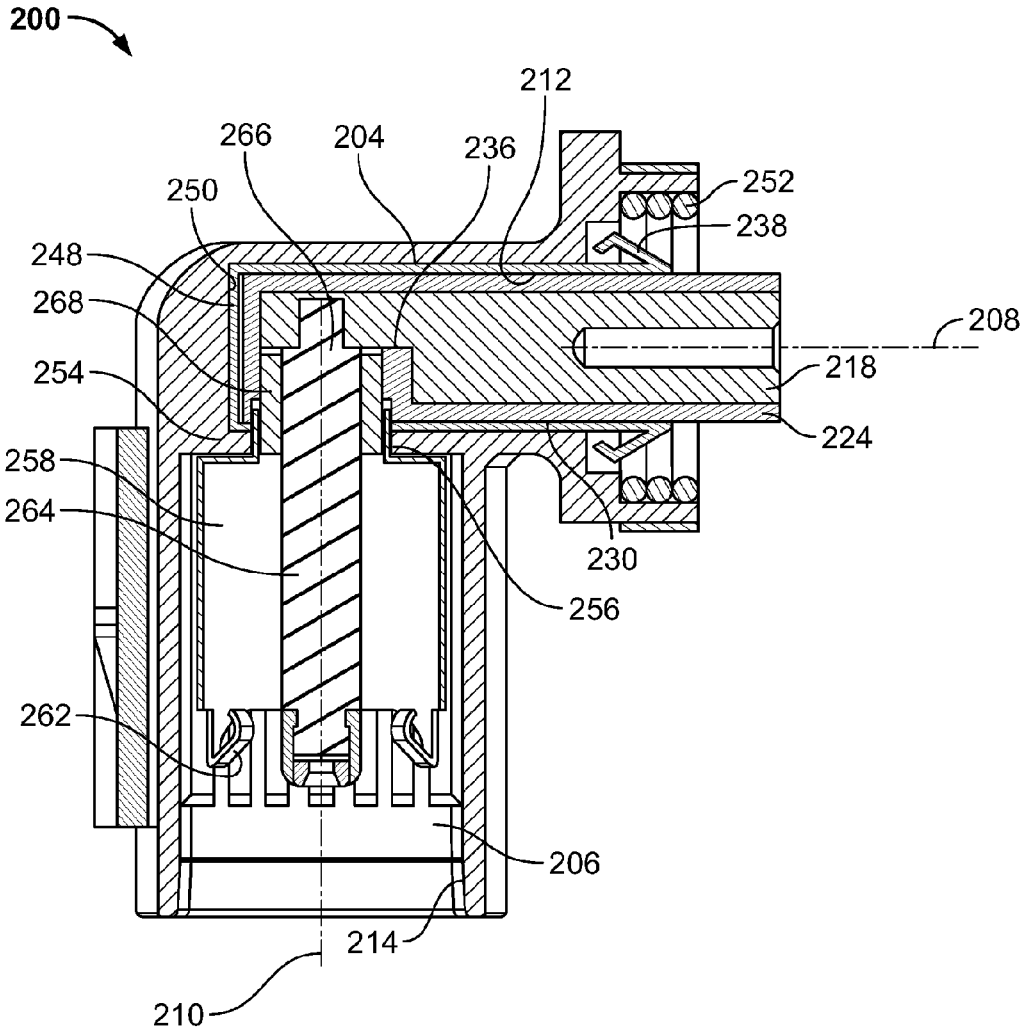
FIG. 13 shows a cross-section on the line C-C of the connector shown in FIG. 8.

FIG. 8 shows a perspective view of the header connector 200 according to the second aspect of the invention. As for the description of the first embodiment, only one side of the connector will be described, but it is to be understood that the header connector is symmetrical about a central plane and is configured to connect two coaxial components to two further coaxial components. The header connector 200 includes an outer insulative housing 202 having a first part 204 having a first central longitudinal axis 208 and a second part 206 having a second central longitudinal axis 210 which intersects the first axis 208 perpendicularly.

A first passageway 212 in the first housing part 204 accommodates a cable connection assembly 216 comprising a core connection member in the form of a terminal 218 having a connection aperture 220 adjacent one end. The terminal 218 is located in a passage 222 in an insulation sleeve 224 having a clearance aperture 226 adjacent one end and the insulation sleeve 224 is located in a passage 228 in a shield member 230 which has an engagement aperture 232 adjacent one end. The terminal 218, the insulation sleeve 224 and the shield member 230 have inter-engaging geometries which cause the apertures 220, 226 and 232 therein to be at least substantially aligned with each other when these components are full engaged with each other. The shield member 230 and the insulation sleeve 224 have complementary square cross-sections and an end 234 of the terminal 218 including the connection aperture 220 has a D-shaped cross-section which corresponds to a corresponding D-shaped end 236 of the passage 222 in the insulation sleeve 224. Other alignment geometries could be used. Shield tangs 238 project outwardly from the shield member adjacent its outer end. The shield member 230 and the terminal 218 are made from a suitable conductive material such as copper alloy. The cable connection assembly 216 is situated in the first passageway 212 in the housing first part 204 which has a square cross-section which is complementary to the square cross-section of the shield member 230. The complementary geometries of the shield member 230 and the first passageway 212 and abutment of an end face 248 of the shield member 230 with an end 250 of the first passageway 212 ensures that the apertures 220, 226 and 232 are at least substantially aligned with the second axis 210 of the second passageway 214 in the second part 206 of the housing.

The cable connection assembly 216 is connectable to a coaxial component with the shield of the coaxial component connected to shield tangs 238 which project outwardly from an outer surface of the shield member 230 adjacent its outer end and a core of the coaxial component connected to an aperture 270 in an outer end of the terminal 218 which may be screw-threaded for receiving a fastener.

Projecting outwardly from the first part 204 of the housing is a flange 240 containing holes 244 having bushes 246 located therein for receiving fasteners for securing the header connector 200 to a support surface. A collar 242 extends away from the flange 240 and a seal 252 is located inside the collar 242.

The second passageway 214 in the second part 206 of the housing is centred on the second axis 210 and is divided from the first passageway 212 by a dividing wall 254 having a through hole 256 also centred on the second axis 210. A second shield member in the form of a shield contact 258 is situated in the second passageway 214 with a leading end 260 projecting through the hole 256 in the dividing wall 254 and engaging the engagement aperture 232 of the shield member 230 by means of an interference push-fit so that the shield contact 258 can simply be blind engaged with the shield member 232 by being pushed into the second passageway 214 thereby facilitating production of the header connector. Other means of inter-engagement of the shield contact 258 with the shield member 230 are possible such as those described with reference to the first embodiment. Spring contacts 262 are provided on the shield contact 258 for engagement with a shield member of a complementary plug which is not illustrated.

An insulating collar 268 is situated inside the leading end 260 of the shield contact 258 and extends past the leading end 260 and into the clearance aperture 226 of the insulation sleeve 224 with which it is an interference fit. A distal end 266 of a core connection member in the form of a core contact 264 extends through the insulating collar and into electrical engagement with the connection aperture 220 of the terminal 218, with which it is an interference push-fit. Such engagement permits the core contact 264 to be blind mated with the terminal by simply being pushed into the second passageway 214 of the housing 202. Other means of engagement between the distal end 266 of the core contact 264 and the connection aperture 218 are possible; for example these components may be connected by inter-engaging screw-threaded engagement means or by a threaded fastener. It is important that the core contact 264 is brought into contact with the terminal 218 by movement of the core contact 264 along and/or in the second passageway 214 to permit blind mating of these components.

The above described embodiments of the invention provide externally insulated 90° coaxial connectors which are compact and employ a one-piece housing. Fabrication of the connectors can be effected by movement of core and shield members along and/or in passageways of the housings thereby avoiding the need for multi-part housings and associated additional seals. Features of one embodiment may be used in connection with features of the other embodiment and it will be understood that variations of the embodiments may be made without departing from the scope of the invention as defined by the claims.

The invention claimed is:

1. An externally insulated coaxial connector for connecting two electrical coaxial components, the connector comprising an insulative housing defining first and second intersecting passageways for respectively receiving at least portions of the coaxial components and having first and second respective longitudinal axes which are not aligned with each other, the connector further comprising a first shield member which is at least partly accommodated by the first passageway and a second shield member which is at least partly accommodated by the second passageway, the first shield member having an inner end and a contact end, the inner end having a first engagement member within an intersection of the first and second passageways and aligned with the second passageway, wherein the first shield member is engageable with the second shield member by movement of the second shield member along the second longitudinal axis, and first and second electrical terminals positioned within the first and second shield members.

2. The connector of claim 1 wherein the first and second longitudinal axes are substantially perpendicular to each other.

3. The connector of claim 1 wherein the shield members include push-fit inter-engagement means.

4. The connector of claim 3 wherein the push-fit inter-engagement means includes at least one resilient detent.

5. The connector of claim 4 wherein the push-fit inter-engagement means comprises an aperture in one of the shield members an inwardly facing surface of which is engaged by plural resilient detents of the other shield member.

6. The connector of claim 1 wherein the electrical terminal includes a first core connection member which is at least partly accommodated within one of the passageways and a second core connection member which is at least partly accommodated by the other passageway and is engageable with the first core connection member by movement of the second core connection member with respect to its respective passageway.

7. The connector of claim 6 wherein the core connection members include push-fit inter-engagement means.

8. The connector of claim 6 wherein the first shield member is hollow and accommodates the first core connection member with an insulation member therebetween.

9. The connector of claim 8 wherein the second core connection member extends through a clearance aperture in the first shield member and an aperture in the insulation member.

10. The connector of claim 6 wherein the shield member and the core connection member at least partly accommodated by one of the passageways are electrically isolated from each other by an annular insulation wall constituting part of the housing.

11. The connector of claim 1 configured for connection to a coaxial cable and a coaxial plug which constitute the two coaxial components.

12. The connector of claim 1 including a strain relief member including at least one barb positioned to bite into an external layer of a coaxial cable and configured to be urged deeper into the external layer as a consequence of urging of the cable outwardly of the housing.

13. The connector of claim 1 wherein the housing is a one-piece housing.

14. A method of assembling an externally insulated coaxial connector for connecting two electrical coaxial components, the method comprising the steps of: (a) providing a one piece insulative housing defining first and second intersecting passageways having central longitudinal axes which are not aligned with each other; (b) inserting a first core connection member within a first shield member and inserting the first core connection member and the first shield member at least partly into the first passageway towards the intersecting passageways; and (c) inserting a second shield member at least partly into the second passageway towards the intersecting passageways so that it engages and electrically connects with the first shield member at a position within the intersecting passageways.

15. The method of claim 14 including the additional step of positioning the first core connection member at least partly within the first shield member with an insulation member therebetween.

16. The method of claim 15 including the additional step of assembling the first core connection member, the first shield member, and the insulation member together into a first assembly, and positioning the first assembly into the first passageway; and inserting a second core connection member at least partly into the second passageway so that it engages and electrically connects with the first core connection member.

17. An insulated coaxial connector for connecting two electrical coaxial components, the connector comprising:

a one-piece insulative housing having two connecting passageways, with access to the passageways provided at each open end, and each passageway having a central longitudinal axis, the central longitudinal axes being non-aligned; and coaxial shield and signal contact components being insertable through the open ends of the passageways and being electrically connected at a position within the intersection of the non-aligned central longitudinal axes.

* * * * *